United States Patent [19]

Cornelius et al.

[11] 4,159,061

[45] Jun. 26, 1979

[54] POP-A-TOP CANNING JAR LIDS

[76] Inventors: Bille F. Cornelius, 2304 McBurney Dr.; Robert E. Collins, 2308 McBurney Dr., both of Florence, Ala.

[21] Appl. No.: 790,806

[22] Filed: Apr. 25, 1977

Related U.S. Application Data

[63] Continuation-in-part of Ser. No. 604,894, Sep. 8, 1975, abandoned.

[51] Int. Cl.[2] ..... B65D 53/02; B65D 41/32

[52] U.S. Cl. ..... 215/255; 215/256; 215/275; 215/276; 220/276; 220/320

[58] Field of Search ..... 215/255, 256, 258, 275, 215/276; 220/270, 276, 320, 324

[56] References Cited

U.S. PATENT DOCUMENTS

| | | | |
|---|---|---|---|
| 1,978,978 | 10/1934 | Bailey | 215/276 |
| 3,332,565 | 7/1967 | Elser | 215/255 |
| 3,437,254 | 4/1969 | Bergstrom | 215/275 |
| 3,445,023 | 5/1969 | Giessler et al. | 215/276 |
| 3,836,033 | 9/1974 | Podesta | 215/276 |

FOREIGN PATENT DOCUMENTS

| | | | |
|---|---|---|---|
| 1434730 | 5/1976 | United Kingdom | 215/255 |

*Primary Examiner*—William Price
*Assistant Examiner*—Joseph Man-Fu Moy
*Attorney, Agent, or Firm*—Strauch, Nolan, Neale, Nies & Kurz

[57] ABSTRACT

A closure assembly for a glass canning jar has an internally threaded skirt portion and a transverse lid portion having a rim section separated from a center section by a continuous weakened region in the form of a surface groove. A manual pull member is mounted on the center section. The transverse lid portion may be integral with the skirt or may comprise a separate member.

2 Claims, 5 Drawing Figures

FIG. 1
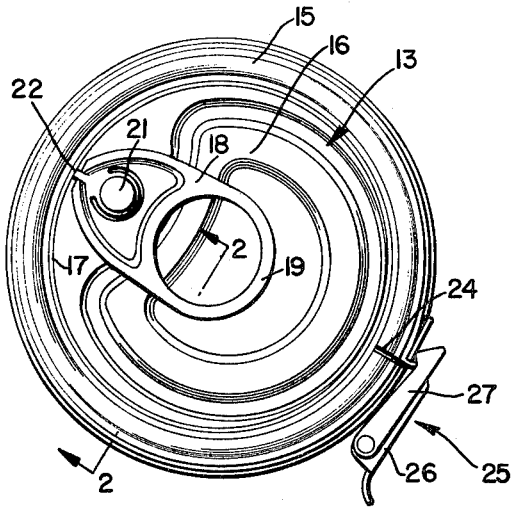
FIG. 3
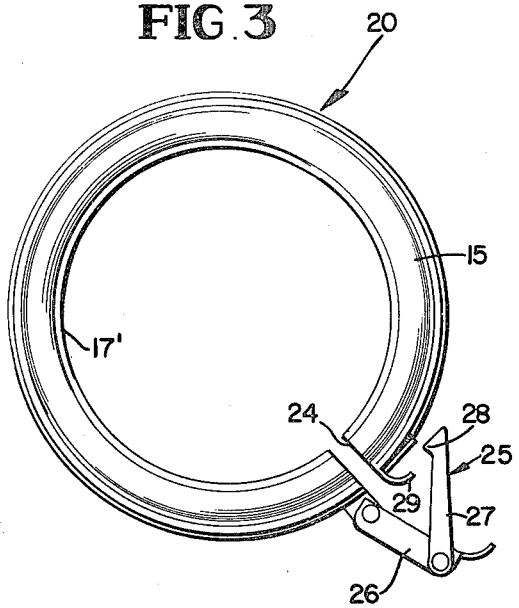
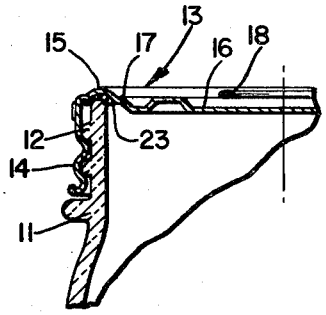
FIG. 2
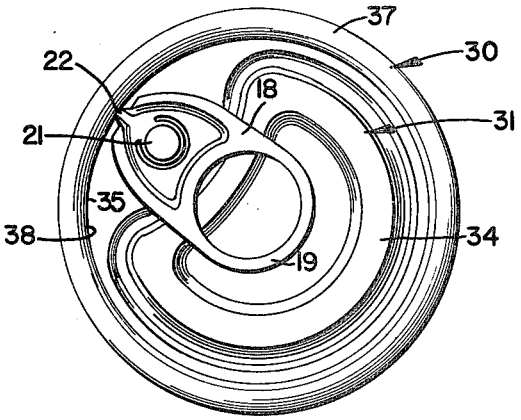
FIG. 4
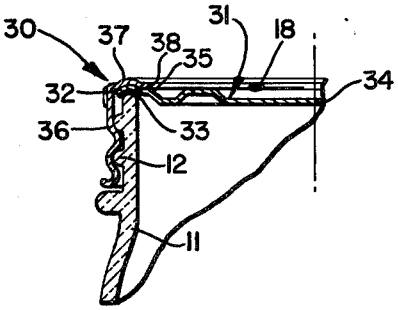
FIG. 5

POP-A-TOP CANNING JAR LIDS

This is a continuation-in-part of copending application Ser. No. 604,894 filed Sept. 8, 1975 now abandoned.

This invention relates to metal closures for canning jars, especially home cannig jars, and is particularly concerned with such closures wherein the central portion may be readily entirely removed with a simple pulling action.

Conventionally fruits, vegetables and the like are home canned in glass jars to which are attached sealed closures. One of the most common types is the so-called mason jar which is a wide mouthed glass jar having integral external threades around its neck for mounting an internally threaded cup-shaped metal closure assembly, with a flat sealing ring of rubber or the like compressed between the edge of the jar opening and the inside of the closure.

The closure assemblies for conventional mason jars are of two types. One embodies an integral metal member wherein an internally threaded skirt depends from a transverse lid portion that extends over the jar mouth, with the rubber seal annulus clamped between the jar edge and an outer annular rim section of the transverse portion that extends between the upper end of the skirt and the center section of the lid. The other is a two part structure wherein a separate transverse lid portion is seated directly in covering relation on the edge of the jar mouth, with an annulus of rubber between its outer rim section and the jar edge, and a securing portion comprises a ring having an annular rim section overlying the rim section of the lid portion and an integral depending internally threaded skirt that may be screwed onto the jar neck until the rim sections are in tight axial contact and the rubber annulus is compressed.

The present invention provides an improvement in the foregoing mason-type jar closures, for example enabling the contents of a jar to be removed without unscrewing the closure assembly which may be stuck for example.

It is a major object of the present invention to provide a novel metal closure assembly for a mason-type canning jar wherein substantially the entire center section of the transverse lid portion that extends over the jar mouth may readily be separated with a simple manual pull operation.

A further object of the invention is to provide a novel metal mason-type canning jar closure assembly wherein a continuous weakened region extends around the center section of the transverse lid portion just inwardly of the rim section that clamps the sealing annulus upon the jar mouth edge, a pull member which may be of the ring type being mounted on the center section.

Pursuant to the foregoing object of the weakened region may be a continuous surface groove in the lid portion.

Another object of the invention is to provide a novel metal closure assembly for a mason-type canning jar wherein the threaded skirt for securing the assembly to the jar and an adjacent rim section radially outwardly of the weakened region are formed with a continuous split and latch means are provided for contracting the skirt to substantially cylindrical form about the jar neck.

Further novel features and other objects of this invention will become apparent from the following detailed description, discussion and the appended claims taken in conjunction with the accompanying drawings.

Known prior art relevant to the foregoing are Elser U.S. Pat. No. 3,332,565 which discloses a tear strip in a metal closure for a glass jar, Overmyer 2,135,835 which discloses a mason-type closure assembly, and Griffiths British Pat. No. 5082 of 1907 which discloses a circumferentially tightened closure latch. Some commercial peanut and like cans of nuts have removable metal covers surrounded by weakened sections and provided with pull members for removing them.

BRIEF DESCRIPTION OF DRAWINGS

FIG. 1 is a top plan view showing a closure assembly of the invention according to a preferred embodiment;

FIG. 2 is a fragmentary partial section showing detail of the structure of FIG. 1;

FIG. 3 is a top plan view showing the condition of the closure assembly of FIG. 1 after the central section is removed;

FIG. 4 is a top plan view showing a further embodiment wherein the closure assembly is in two separate pieces; and FIG. 5 is a fragmentary partial section showing detail of the closure assembly of FIG. 4.

PREFERRED EMBODIMENTS

Referring to FIGS. 1–3 a wide mouth conventional glass canning jar 11 has at its upper open neck an integral external thread formation 12 for mounting an internally threaded closure assembly 13.

Closure assembly 13 is of integral metal construction, usually aluminum, comprising an annular internally threaded longitudinal skirt portion 14 a transverse lid portion consisting of an annular rim section 15 and a transverse center section 16.

A circular weakened region 17 extends around the lid portion just inwardly of the rim section 15, in effect defining a boundary between the rim and central sections. This weakened region preferably comprises a continuous surface groove.

A pull member 18 having a finger ring 19 at one end and having its other end secured normally flat as by a solder rivet 21 upon the outside surface of transverse central section 16 has a tip 22 fixed to the outer perimeter of center section 16.

An annular sealant ring 23 of synthetic rubber is compressed between rim section 15 and the upper edge of jar 11 when the closure assembly is installed.

As shown in FIGS. 1 and 3 the skirt 14 may be formed with a longitudinal slit 24 that extends continuously transversely through rim section 15 to the edge of weakened region 17. A buckle type latch 25 comprises an arm 26 pivoted at one end on skirt 14 at one side of slot 24, a locking element 27 pivoted to the other end of arm 26 and terminating in a tooth 28 which when the latch is closed as in FIG. 1 engages in a keeper 29 on skirt 14 at the other side of slot 24. The parts are so dimensioned that when latch 25 is closed the periphery of skirt 14 is contracted circumferentially to clamp tightly on the jar neck threads, and when latch 25 is released to the position shown in FIG. 3 the clamping action is released so that the closure assembly may be readily unscrewed.

In use the closure assembly is threadedly mounted on the jar neck threads in the position of FIG. 2, and latch 25 is closed as shown in FIG. 1. The closure is now in sealing condition with sealant annulus 23 compressed axially between the jar neck end and the rim section 15.

The weakened region at 17 is strong enough to withstand normal pressures and handling during canning and storage.

When it is desired to remove the contents of the jar 11, the user merely lifts up on ring 19 breaking the rivet 21 and effectively pivoting pull member 18 about tip 22, and pulls sharply upwardly. This results in rupture of weakened region 17 and bodily removal of the entire center section 16, leaving remaining as shown in FIG. 3 an interrupted annular ring 20 comprising skirt 14, rim 15 and the latch. The circular inner periphery of the ring 20 is indicated at 17' and its diameter is preferably equal to that of the jar mouth. Latch 25 is usually closed when center section 16 is detached.

While the center section 16 is discarded, the ring 20 is now available for use as one part of a two part closure assembly such as shown in FIGS. 4 and 5, as will appear.

Referring to FIGS. 4 and 5, the metal closure assembly comprises a ring 30 having internal threads for mounting the closure on jar 11, and a separate transverse lid portion 31.

Lid portion 31 has a diameter sufficient that its outer peripheral rim section 32 overlies the edge of the jar mouth. A resilient sealant annulus 33 is compressed between rim section 32 and the jar neck. Rim section 32 and center section 34 of the lid portion have formed between them a circular weakened region 35 similar to region 17 of the embodiment of FIGS. 1-3 and of about the same diameter. A pull member 18 is mounted on center section 34 as in FIG. 1 with its tip 22 fixed thereon at the weakened region 35.

The ring 30 consists of an internally threaded skirt 36 and an integral annular rim section 37 that extends transversely inwardly to conformably overlie rim section 32 in the assembly. The circular internal periphery 38 of rim section 37 is of about the same diameter as weakened region 35.

In this embodiment the lid portion is placed over the open jar neck with annulus 33 in place and ring 30 is threaded onto the neck until the rim sections 37 and 32 are tightly in contact thereby clamping the closure assembly tight and compressing the sealant annular 33. In some forms the lid portion 31 may include a permanently bonded sealant ring 33 around the bottom surface of rim section 32. It is within the scope of the invention that the ring of FIGS. 4 and 5 may be a split ring with a contracting latch such as shown in FIG. 3.

It will also be noted that ring 20 which remains after center section 16 is detached in FIGS. 1-3 may be used as the ring 30 in a future assembly accordig to FIGS. 4 and 5. This is an important feature, since the housewife may purchase a commercially filled jar of food having the closure of FIGS. 1-3, and then after pulling off center section 16 and using the contents may reuse the jar and the remaining ring for home canning. All that is required is purchase of a lid such as 31, which lids may be available in boxed sets of ten or more for example.

In the FIG. 4 and 5 embodiment after center section 34 is removed and the contents of the jar used, the jar and ring 30 (or 20) may be reused, all that is required being a new lid portion 31 with suitable sealant annulus.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A closure assembly for a mason-type glass jar having an externally threaded top neck with an upper edge defining a wide mouth comprising an internally threaded skirt portion adapted to be screwed on said neck, and a transverse lid portion formed in one piece with said skirt portion covering said mouth, said transverse lid portion comprising a relatively narrow annular rim section extending inwardly from the upper end of said skirt portion to overlie the upper edge of said neck and a center section, there being a sealant annulus adapted to be compressed between said rim section and said jar mouth edge, means forming a continuous weakened region in said lid portion located to define an iner periphery of said rim section and an outer periphery of said center section and thereby establishing a boundary between said rim section and said center section, and means providing a continuous longitudinal slit in said threaded portion and the adjoining rim section, latch means on said skirt portion for contracting said skirt portion about the neck threads when the assembly is mounted on the jar, and a manual pull member on said center section whereby when said pull member is operated said entire center section may be removed from said lid portion to expose the contents of the jar on which the closure assembly is mounted.

2. In the closure assembly defined in claim 1, said latch assembly comprising releasably interlocking members mounted on said skirt portion at opposite sides of said slit.

* * * * *